US006341990B1

(12) United States Patent
Fukuda

(10) Patent No.: US 6,341,990 B1
(45) Date of Patent: Jan. 29, 2002

(54) STRUCTURE FOR CONNECTING BATTERY TERMINAL

(75) Inventor: Eiji Fukuda, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/925,316

(22) Filed: Aug. 10, 2001

(30) Foreign Application Priority Data

Aug. 10, 2000 (JP) ..... 12-243020

(51) Int. Cl.[7] ..... H01R 4/28
(52) U.S. Cl. ..... 439/761; 439/341; 439/754
(58) Field of Search ..... 439/761, 719, 439/770, 772, 773, 771, 754, 759, 376, 341

(56) References Cited

U.S. PATENT DOCUMENTS 1,977,179 A * 10/1934 Fisch ..... 439/761
3,307,140 A * 2/1967 Vallinotto et al. ..... 439/726
3,413,593 A * 11/1968 Schaefer ..... 439/522
3,521,223 A * 7/1970 Martinez ..... 439/726
3,838,386 A * 9/1974 Chartrain et al. ..... 439/726
3,973,820 A * 8/1976 Benson ..... 439/726
4,695,118 A * 9/1987 Magdesyan et al. ..... 439/726
5,389,466 A * 2/1995 Inoue et al. ..... 429/178
5,595,510 A * 1/1997 Oblingar ..... 439/761
5,897,403 A * 4/1999 Kourimsky ..... 439/761

FOREIGN PATENT DOCUMENTS

JP 6-60053 8/1994 ..... H01M/2/20

* cited by examiner

*Primary Examiner*—Tulsidas Patel
(74) *Attorney, Agent, or Firm*—Sughrue Mion, PLLC

(57) ABSTRACT

In a structure for connecting a battery terminal to a battery post of a battery, a terminal body has a U-shaped curved portion which is formed between a distal end portion and a proximal end portion of the battery terminal. A retaining portion, at which the distal end portion of the battery terminal is retained, is provided in the vicinity of the battery post. Locking members lock the proximal end portion of the battery terminal in a position where the proximal end portion has been pivoted in a leverage manner while the distal end portion is retained in the retaining portion as a fulcrum, and while the U-shaped curved portion is press-fitted onto an outer periphery of the battery post.

7 Claims, 17 Drawing Sheets

PRIOR ART

PRIOR ART

STRUCTURE FOR CONNECTING BATTERY TERMINAL

BACKGROUND OF THE INVENTION

This invention relates to a structure of connecting a battery terminal to an electrode (battery post) of a battery mounted on an automobile or the like, and more particularly to a battery terminal-connecting structure in which the battery terminal can be fitted on the battery post by one action (one operation) without the use of a fastening tool such as an impact wrench.

Japanese Utility Model Publication No. 6-60053U discloses one related connecting structure in which a battery terminal can be fitted on a battery post without the use of a fastening tool such as an impact wrench.

FIG. 16 shows the construction of the battery terminal disclosed in the above publication. In this battery terminal 30, a cam lever (operating lever) 32 is pivotally mounted on a terminal body 31. The terminal body 31 includes a post fitting portion 33, bent and curved into a generally C-shape or annular shape, and a pair of parallel pieces 34 and 35 extending respectively from both ends of the C-shaped post fitting portion 33. A pivot shaft 36 is mounted on the pair of extended pieces 34 and 35, and the cam lever 32 is pivotally supported on this pivot shaft 36. An electric wire W is connected to one extended piece 34.

The operation will be described with reference to FIGS. 17A and 17B. When the cam lever 32 is in an upstanding condition as shown in FIG. 17A, a cam portion 32*a* of this cam lever 32 is disposed in an upright condition, and therefore the bore of the post fitting portion 33 of the battery terminal 30 is increased. Therefore, in this condition, the post fitting portion 33 can be easily fitted on a battery post 40.

After the post fitting portion 33 is fitted on the battery post 40, the cam lever 32 is brought down as shown in FIG. 17B, so that the cam portion 32*a* is pressed against a peripheral face of the battery post 40. As a result, an inner peripheral face of the post fitting portion 33 of the battery terminal 30 is pressed against the peripheral face of the battery post 40 by a reaction force produced by the pressing action of the cam portion 32*a*. As a result, the battery terminal 30 is electrically and mechanically connected to the battery post 40 by a friction force generated between the inner peripheral face of the post fitting portion 33 and the outer peripheral face of the battery post 40.

In the above related connecting structure, for fitting the battery terminal 30 on the battery post 40, there are required two actions, that is, (1) fitting the post fitting portion 33 onto the battery post 40; and (2) pivoting the cam lever 32. Therefore, much time and labor have been required for this operation.

SUMMARY OF THE INVENTION

With the above problem in view, it is an object of this invention to provide a connecting structure in which a battery terminal can be fitted on a battery post by almost one action, and the efficiency of the fitting operation is enhanced.

In order to achieve the above object, according to the present invention, there is provided a structure for connecting a battery terminal to a battery post of a battery, comprising:

a terminal body, having a U-shaped curved portion which is formed between a distal end portion and a proximal end portion of the battery terminal;

a retaining portion, at which the distal end portion of the battery terminal is retained, the retaining portion provided in the vicinity of the battery post; and locking members, which lock the proximal end portion of the battery terminal in a position where the proximal end portion has been pivoted in a leverage manner while the distal end portion is retained in the retaining portion as a fulcrum, and while the U-shaped curved portion is press-fitted onto an outer periphery of the battery post.

In this configuration, by almost one action, that is, by pivotally moving the battery terminal, with its distal end portion engaged with the retaining groove, the battery terminal can be fitted onto the battery post, and therefore the fitting operation can be simplified. And besides, the firm press-fitting can be achieved even with a small force because of the leverage action, and therefore the efficiency of the operation is enhanced, and the positive connection is achieved, so that the reliability of the connection can be enhanced.

Preferably, the connecting structure further comprises a cover member which covers the terminal body. The locking members include a first locking member provided on the cover member and a second locking member provided with the battery.

Here, it is preferable that the cover member is made of an insulative material.

In the above configurations, the construction of the battery terminal can be simplified. When this cover member is made of an insulative material, the safety against an electrical shock can be enhanced, and besides in the mounted condition, that portion of the battery terminal, electrically connected to the battery post, can be protected, and therefore the reliability of the electrical connection can be enhanced.

Here, it is preferable that the first locking member is provided as an elastic arm member which is operable from the outside.

In this configuration, cancellation of the locked condition can be easily effected by elastically deforming the arm member, so that the cover member covering the battery terminal can be easily removed from the battery post.

Alternatively, the connecting structure further comprises an adapter member formed with the retaining portion, the adapter member fitted on the battery post such that the retaining portion is placed in the vicinity of the battery post. The locking members include a first locking member provided on the terminal body and a second locking member formed with the adapter member.

In this configuration, the structure of the battery body can be simplified.

Here, it is preferable that the first locking member is provided as an elastic arm member which is operable from the outside. An insulative grip member is provided on a distal end of the elastic arm member.

In this configuration, cancellation of the locked condition can be easily effected by elastically deforming the arm member, so that the battery terminal can be easily removed from the adapter member.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

A first embodiment of the present invention will now be described with reference to FIGS. 1 to 5.

Figure 1:
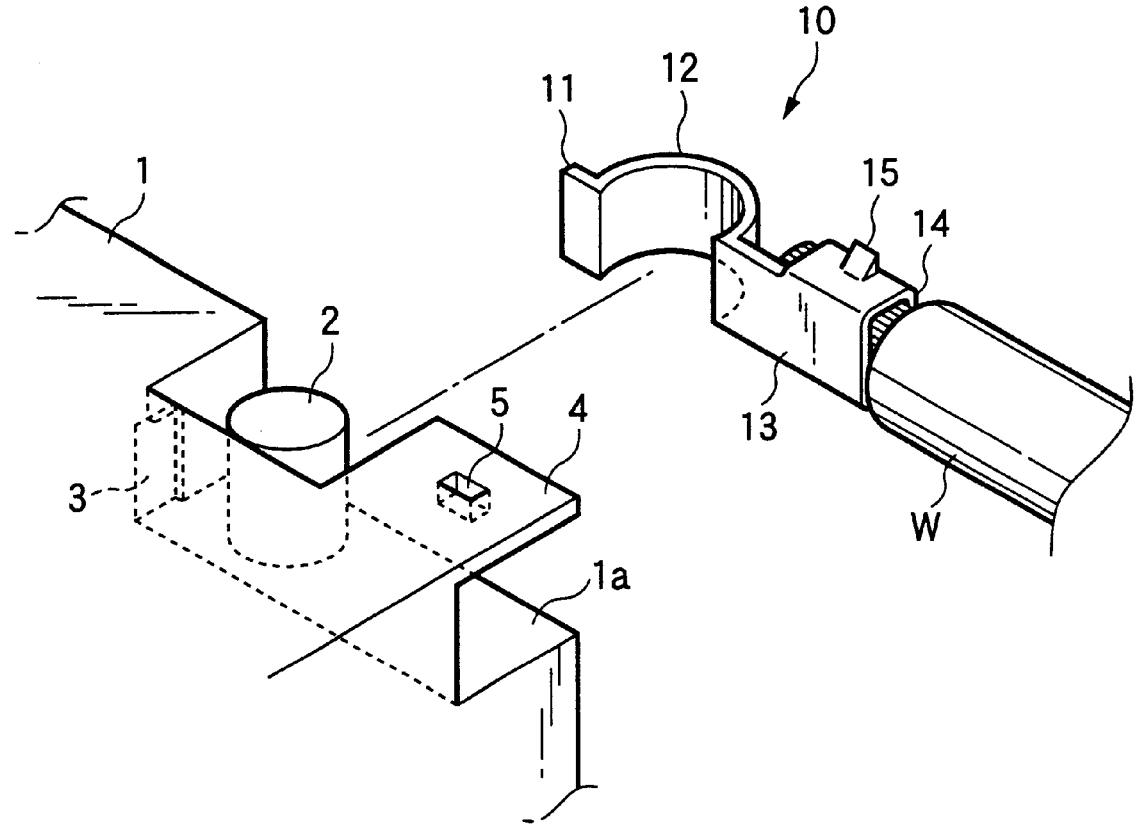
FIG. 1 is a perspective view of a connecting structure according to a first embodiment of the present invention, showing a condition before the fitting of a battery terminal is started.

In FIG. 1, a recess 1*a,* having a rectangular shape when viewed from the top, is formed in a corner portion of a battery, and a battery post 2 is formed on and projects upwardly from a bottom face of this recess 1*a*. The retaining groove 3 is formed in a side face of the recess 1*a* disposed near to the battery post 2, and an eave-like extended wall 4 is provided adjacent to that side of the battery post 2 generally facing away from the retaining groove 3, and this extended wall 4 is disposed in opposed relation to the bottom face of the recess 1*a*. A locking hole 5 is formed through this extended wall 4.

The battery terminal 10 is formed by pressing a metal strip, and a U-shaped curved portion 12 for being press-fitted onto a peripheral face of the battery post 2 is formed between the distal end portion 11 and a proximal end portion 13 of this battery terminal. A damper 14 for clamping an electric wire W is formed at the proximal end portion 13 of the battery terminal 10. A locking projection (lock portion) 15 to be engaged with the locking hole 5 is formed on an upper face of the proximal end portion 13.

Figure 2:
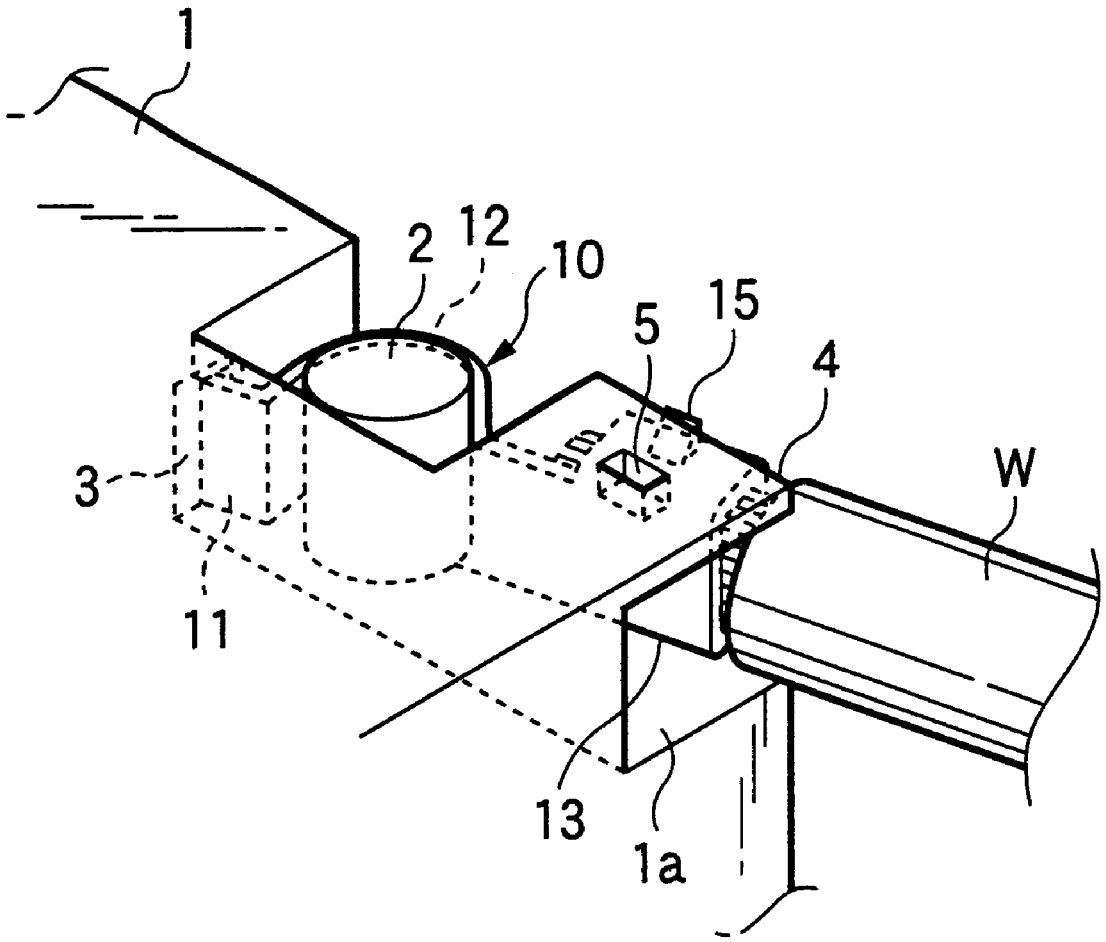
FIG. 2 is a perspective view of the first embodiment, showing a condition in which a distal end portion of the battery terminal is engaged in a retaining groove.
Figure 3:
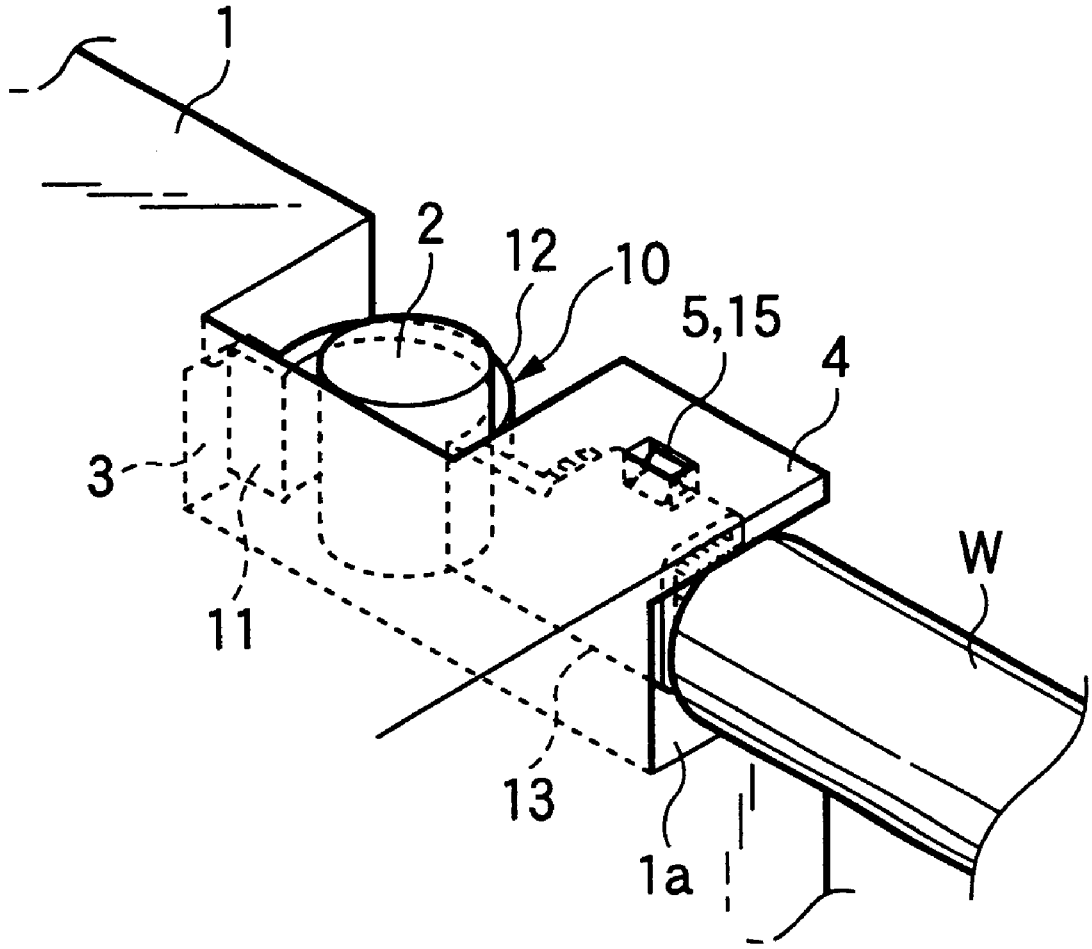
FIG. 3 is a perspective view of the first embodiment, showing a condition in which the battery terminal is pivotally moved until it is locked.
Figure 4:
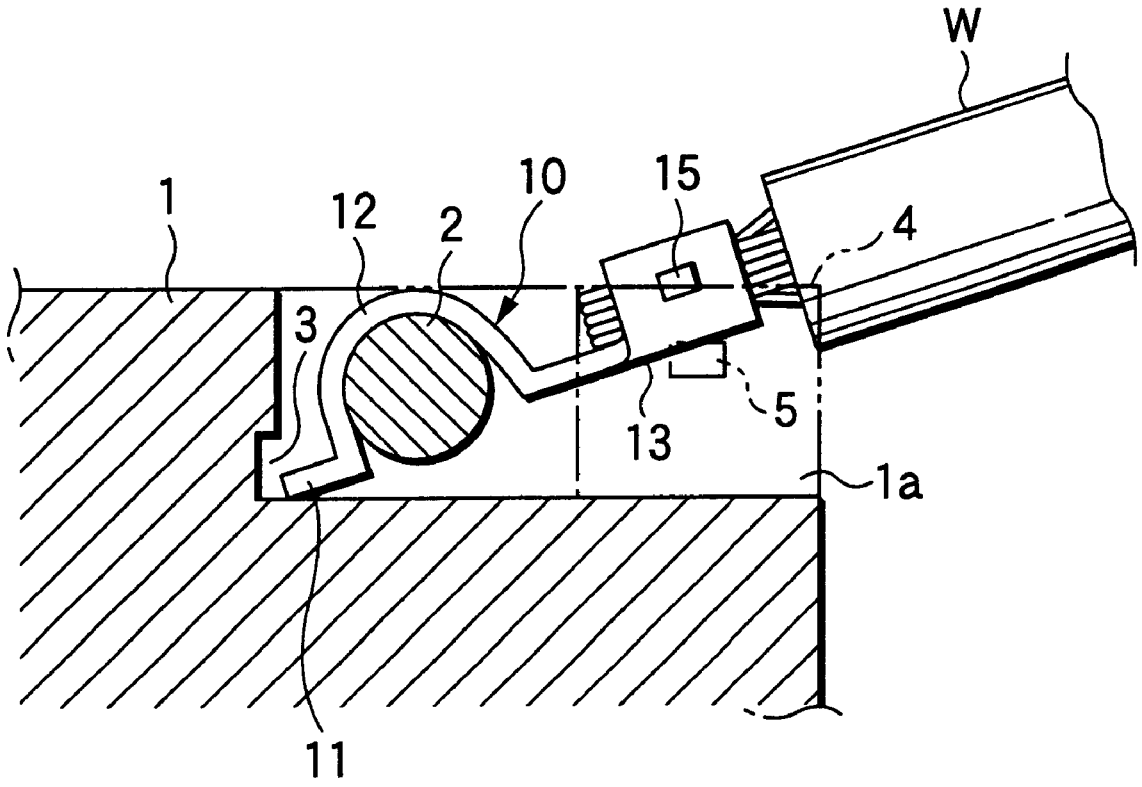
FIG. 4 is a horizontal section view showing the same condition as in FIG. 2.
Figure 5:
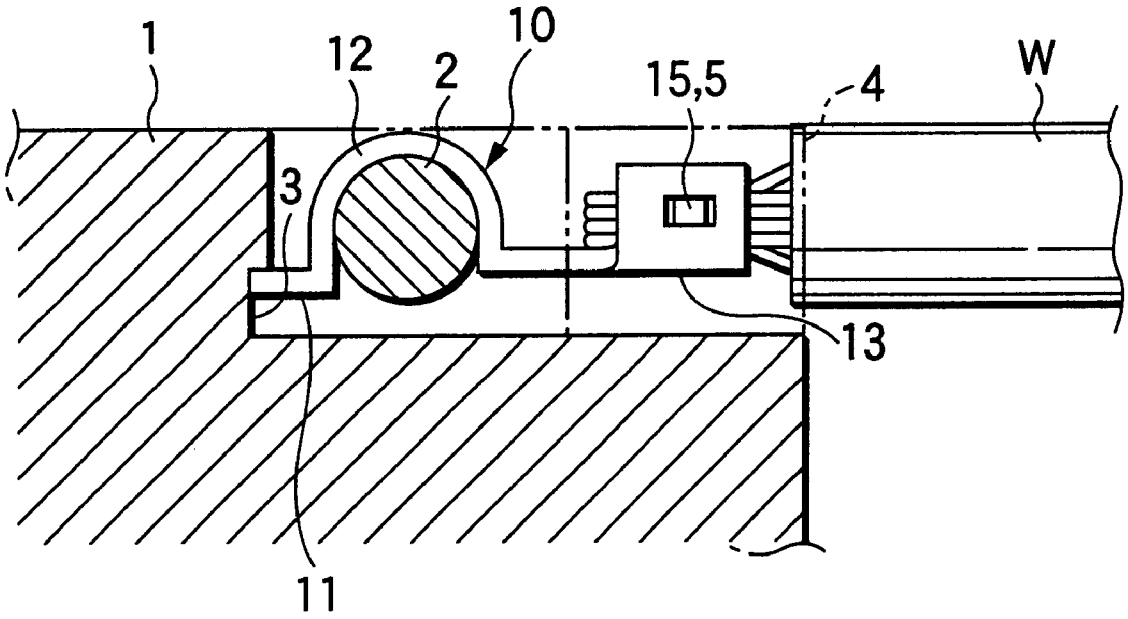
FIG. 5 is a horizontal section view showing the same condition as in FIG. 3.
Figure 6:
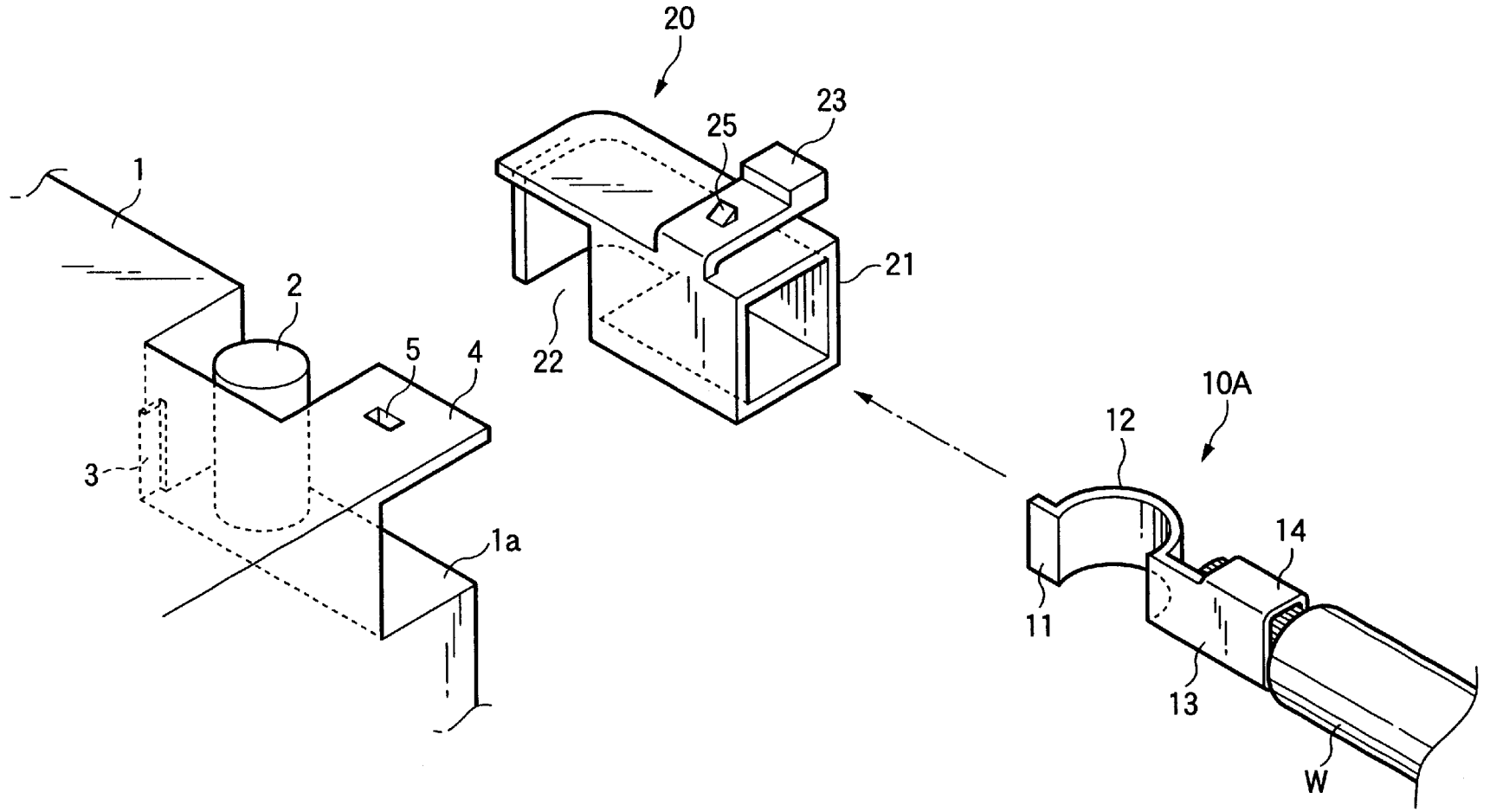
FIG. 6 is an exploded, perspective view of a connecting structure according to a second embodiment of the invention.

For fitting the battery terminal 10 of this construction on the battery post 2, the distal end portion 11 of the battery terminal 10 is engaged in the retaining groove 3, formed near to the battery post 2, as shown in FIGS. 2 and 4, and in this condition the proximal end portion 13 of the battery terminal 10 is pivotally moved toward the battery post 2 about this retaining point as a fulcrum. As a result, the U-shaped curved portion 12, formed between the distal end portion 11 and the proximal end portion 13 of the battery terminal 10, can be firmly press-fitted onto the peripheral face of the battery post 2 with a small force because of the leverage action, as shown in FIGS. 3 and 5.

In this condition, the locking projection 15 on the battery terminal 10 is locked to the locking hole 5 in the battery 1, and therefore the U-shaped curved portion 12 can be positively held in the press-fitted condition relative to the battery post 2.

Thus, by almost one action, that is, by pivotally moving the battery terminal 10, with its distal end portion 11 engaged in the retaining groove 3, the battery terminal 10 can be fitted onto the battery post 2, and therefore the fitting operation can be simplified. In addition, the firm press-fitting can be achieved even with a small force because of the leverage action, and therefore the efficiency of the operation is enhanced, and besides the positive connection is achieved, so that the reliability of the connection is enhanced.

Next, a second embodiment of the invention will be described with reference to FIGS. 6 to 9.

In the structure of this embodiment, a cover 20 is attached to a battery terminal 10A, and in this condition the fitting operation is performed as described above. Although the locking projection 15 is formed directly on the battery terminal 10 in the structure of the first embodiment, a locking projection 25 is formed on the cover 20 in this embodiment. Except this point, this embodiment is similar to the first embodiment, and therefore the description of similar portions will be omitted.

The cover 20 is provided as a resin-molded product for the purpose of insulating and protecting the battery terminal 10A. The cover 20 includes a body 21 of a box-like shape with a closed front end, into which the distal end portion of the battery terminal 10A can be inserted, and an elastic lock arm 23 is formed on an upper face of this body 21. The locking projection 25 to be engaged with a locking hole 5 in a battery 1 is formed on the lock arm 23. A notch 22 is formed in a bottom wall and a side wall of the body 21 at a front end portion thereof and also in a front end wall thereof, and the necessary portion of the battery terminal 10A is exposed to a battery post 2 and the retaining groove 3 through this notch 22.

Figure 7A:
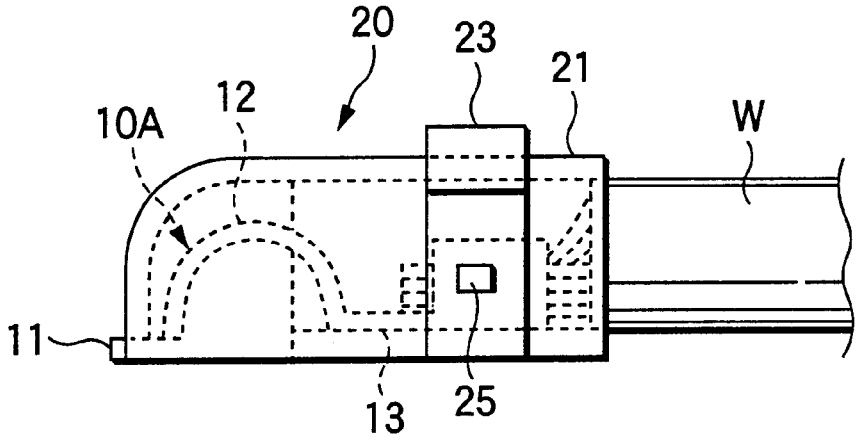
FIGS. 7A and 7B are respectively a plan view and a side-elevational view of the second embodiment, showing a condition in which a cover is attached to a battery terminal.
Figure 7B:
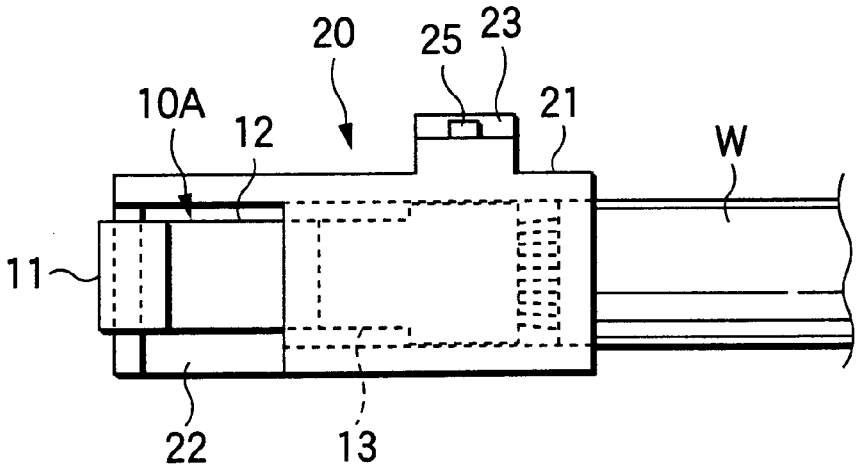

In this structure, for fitting the battery terminal 10A on the battery post 2, first, the battery terminal 10A is inserted into the body 21 of the cover 20 as shown in FIG. 7. As a result, although the distal end portion 11 and a U-shaped curved portion 12 of the battery terminal 10A can be viewed from the exterior through the notch 22, the other portions of this battery terminal are all covered with the cover 20.

Figure 8:
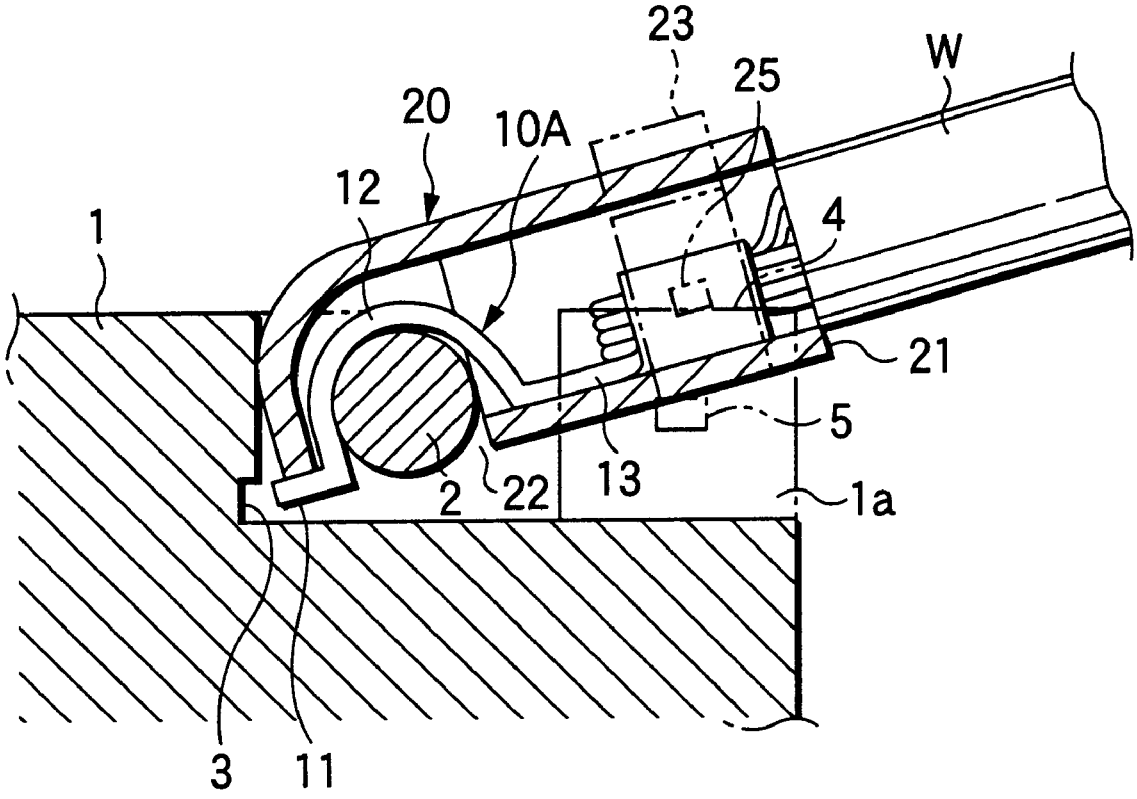
FIG. 8 is a horizontal section view of the second embodiment, showing a condition in which a distal end portion of the battery terminal is engaged in a retaining groove.
Figure 9:
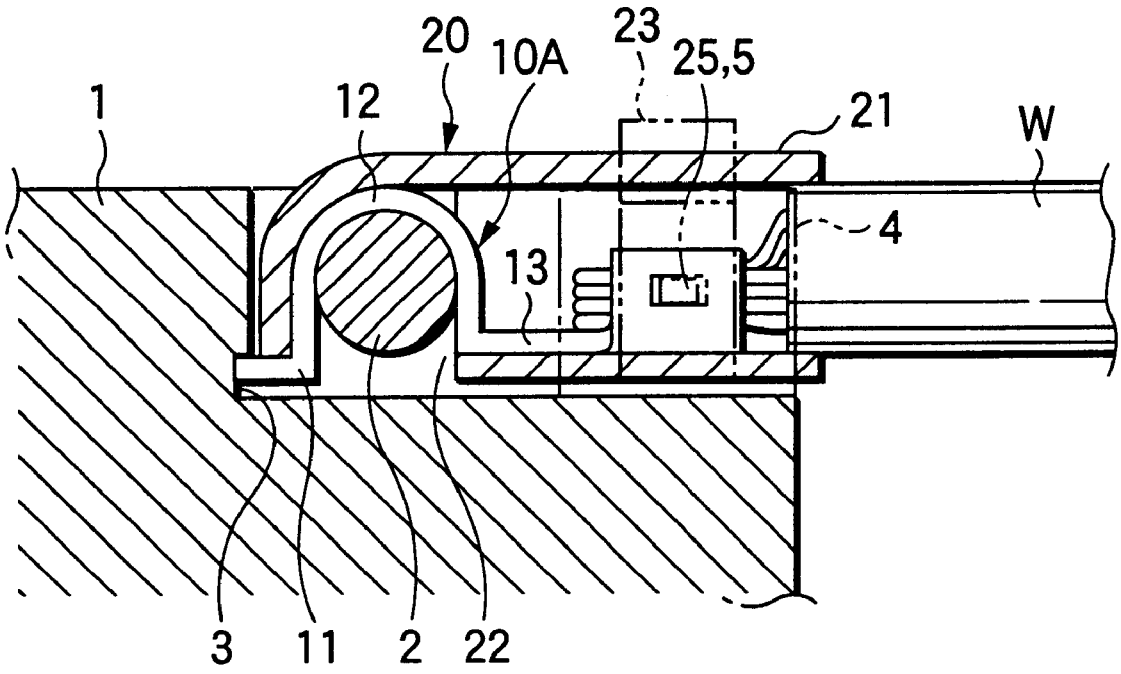
FIG. 9 is a horizontal section view of the second embodiment, showing a condition in which the battery terminal is pivotally moved until it is locked.

The cover 20 and the battery terminal 10A are thus combined together, and then as in the first embodiment, the distal end portion 11 of the battery terminal 10A is engaged in the retaining groove 3 in the battery 1, as shown in FIG. 8, and in this condition a proximal end portion 13 of the battery terminal 10A is pivotally moved toward the battery post 2 about this retaining point as a fulcrum. As a result, the U-shaped curved portion 12, formed between the distal end portion 11 and the proximal end portion 13 of the battery terminal 10A, can be firmly press-fitted onto the peripheral face of the battery post 2 with a small force because of the leverage action, as shown in FIG. 9.

In this condition, the locking projection 25, formed on the cover 20 attached to the battery terminal 10A, is locked to the locking hole 5 in the battery 1, and therefore the U-shaped curved portion 12 can be positively held in the press-fitted condition relative to the battery post 2.

Thus, as in the first embodiment, by almost one action, that is, by pivotally moving the battery terminal 10A, with its distal end portion 11 engaged in the retaining groove 3, the battery terminal 10A can be fitted on the battery post 2, and therefore the fitting operation can be simplified. In addition, the firm press-fitting can be achieved even with a small force because of the leverage action, and therefore the efficiency of the operation is enhanced, and besides the positive connection is achieved, so that the reliability of the connection is enhanced.

In the structure of this second embodiment, the locking projection 25 is formed on the cover 20, and therefore the construction of the battery terminal 10A is simplified. And besides, the cover 20, made of an insulative material, is attached to the battery terminal 10A, and therefore the safety against an electrical shock is enhanced, and in the mounted condition, that portion of the battery terminal, electrically connected to the battery post 2, is protected, and therefore the reliability of the electrical connection is enhanced. Furthermore, the locking projection 25 is formed on the lock arm 23 as provided on a connector, and therefore the locked condition can be easily canceled by elastically deforming the lock arm 23, and the battery terminal 10A can be easily removed from the battery post 2.

Next, a third embodiment of the invention will be described with reference to FIGS. 10 to 15.

In the structure of this embodiment, an adapter 26 is attached to a battery post 2B of the stud bolt-type, and in this condition the fitting operation is performed as described above. Particularly, although the retaining groove 3 and the locking hole 5 are provided directly in the battery 1 in the structure of the first embodiment, a retaining groove 3B and locking claws 29 are provided with the adapter 26 in the structure of this third embodiment. In addition, the structure of the battery terminal 10B is slightly modified. Except these points, this embodiment is similar to the first embodiment, and therefore the description of similar portions will be omitted.

Figure 10:
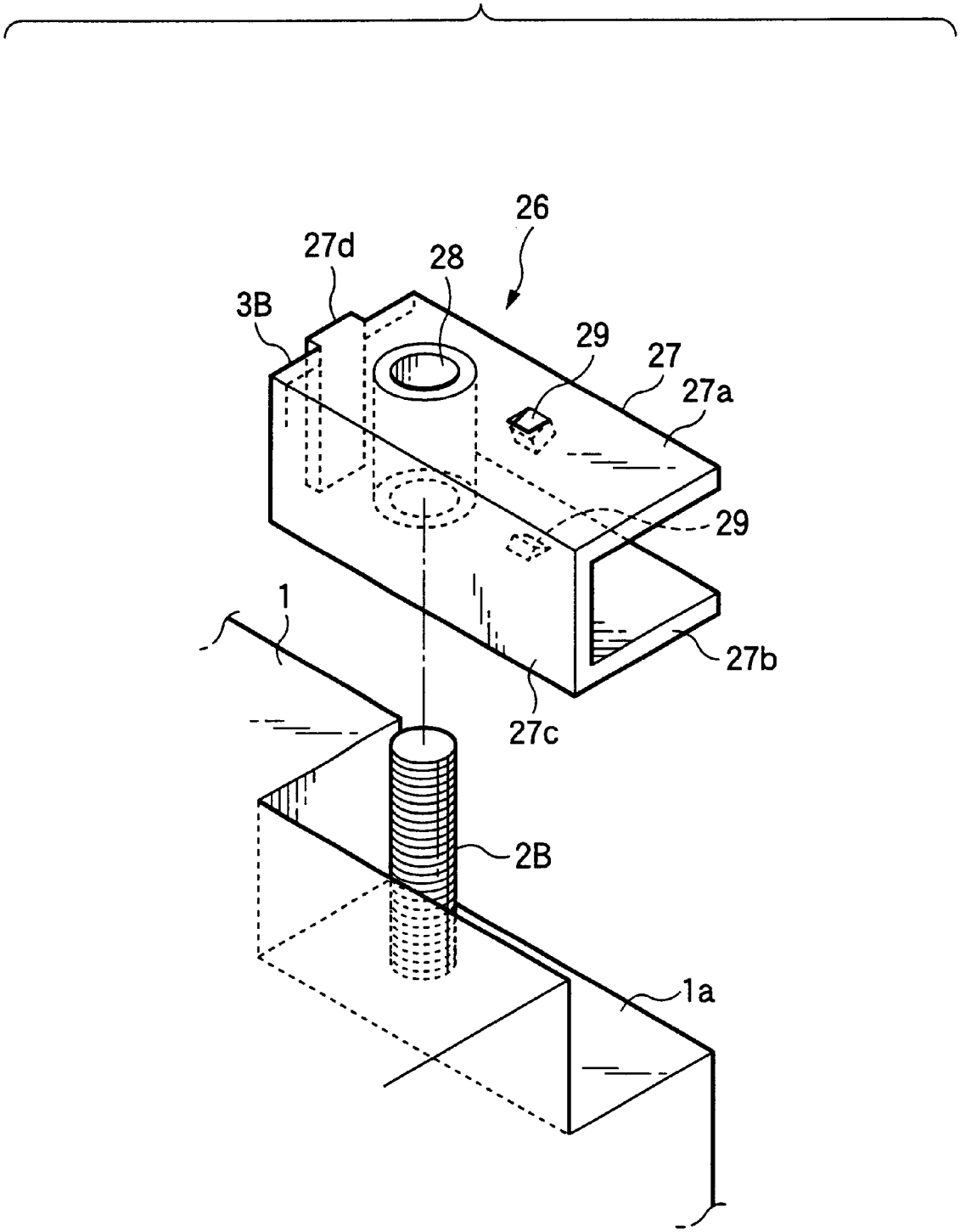
FIG. 10 is an exploded, perspective view of a battery-side structure of a third embodiment of the invention.
Figure 12A:
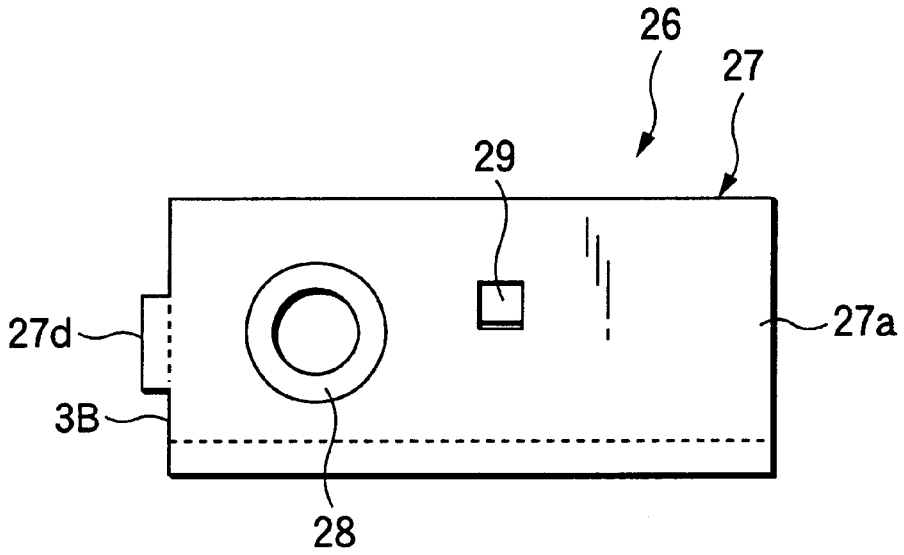
FIGS. 12A and 12B are respectively a plan view and a side-elevational view showing the construction of an adapter used in the third embodiment.
Figure 12B:
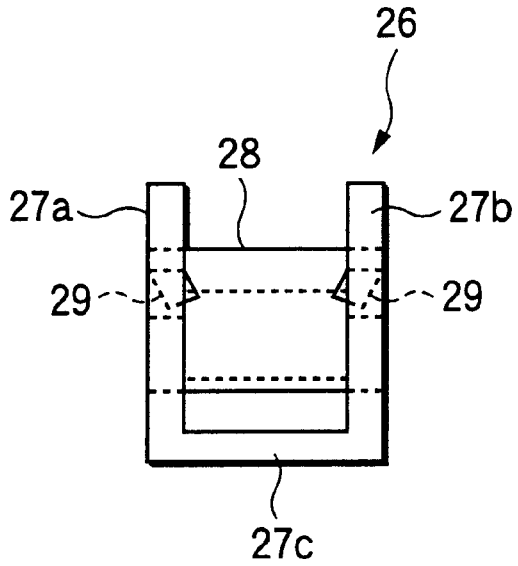

As shown in FIGS. 10 and 12, the adapter 26 includes a box-like body 27 having a U-shaped cross-section, and this body 27 can be fitted in a recess 1*a* in a battery 1. The body 27 includes parallel, opposed upper and lower walls 27*a* and 27*b*, and a side wall 27*c* interconnecting these upper and lower walls, and a cylindrical portion 28 through which the battery post 2B is inserted extends between the upper and lower walls 27*a* and 27*b*. The adapter 26 may be made entirely of metal. Alternatively, the body 27 may be made of a resin, in which case only the cylindrical portion 28 is made of metal, and the two are assembled together thereafter.

A pillar portion 27*d* is formed on one end of the body 27 disposed near to the cylindrical portion 28, and the retaining groove 3B is defined by this pillar portion 27*d*. The locking claws 29 are formed by stamping respectively on those portions of the upper and lower walls 27*a* and 27*b* disposed adjacent to that side of the cylindrical portion 28 generally facing away from the retaining groove 3B.

Figure 11:
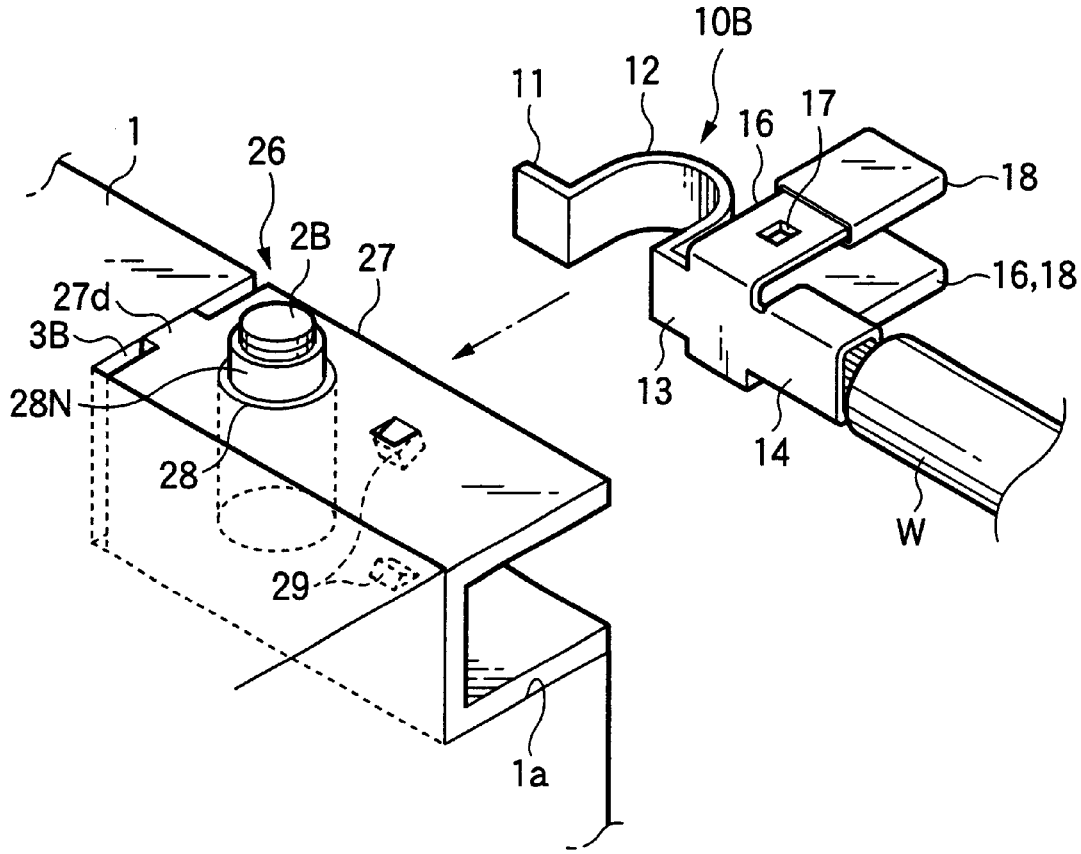
FIG. 11 is a perspective view of the third embodiment, showing a condition before a battery terminal is mounted on a battery post.
Figure 13A:
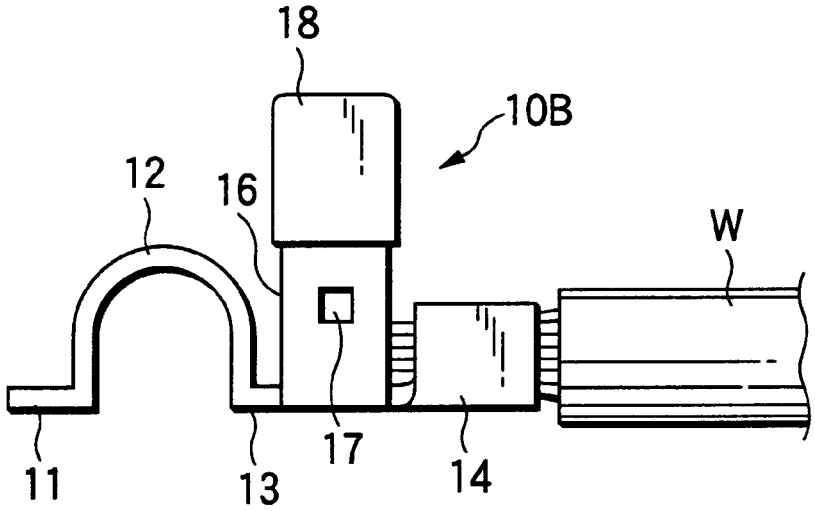
FIGS. 13A and 13B are respectively a plan view and a side-elevational view showing the construction of the battery terminal used in the third embodiment.
Figure 13B:
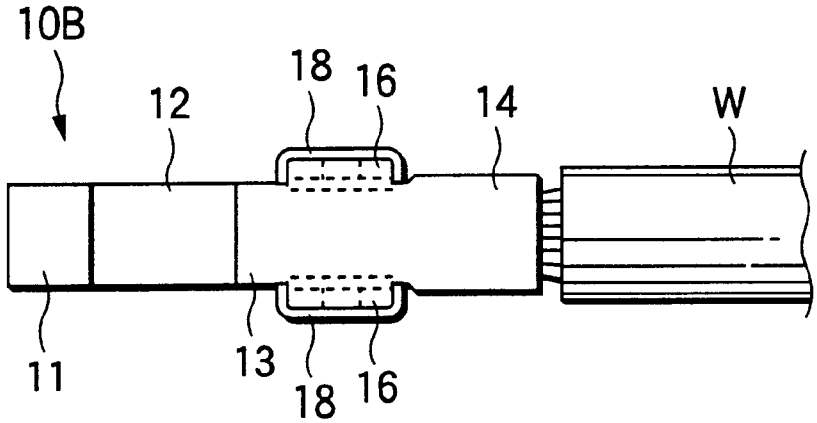

The battery terminal 10B is formed of a metal strip, and is adapted to be attached to the adapter 26 of the above construction. As shown in FIGS. 11 and 13, a U-shaped curved portion 12 for being press-fitted onto the peripheral face of the cylindrical portion 28 of the adapter 26 is formed between the distal end portion 11 and a proximal end portion 13 of the battery terminal 10B. Upper and lower lock arms 16 are formed at the proximal end portion 13 of the battery terminal 10B in a symmetrical manner. Locking holes 17 are formed in these lock arms 16, respectively, and can be locked respectively to the locking claws 29 formed respectively on the upper and lower walls 27*a* and 27*b* of the adapter 26.

In this case, insulating covers 18 are attached to distal end portions of the upper and lower lock arms 16, respectively, and by gripping the distal end portions of the lock arms 16 (to which the insulating covers 18 are attached, respectively) by the fingers or others, the two lock arms 16 can be elastically deformed so that the locking and the cancellation of this locked condition can be easily effected. A damper 14 for clamping an electric wire W is formed at that portion of the proximal end portion 13 of the battery terminal 10B closer to the proximal end thereof than the lock arms 16.

In this structure, for fitting the battery terminal 10B on the battery post 2B, first, the adapter 26 is fitted into the recess la in the battery 1 such that the cylindrical portion 28 of the adapter 26 is fitted on the battery post 2B, as shown in FIG. 11. In this condition, a nut 28N is fastened to a distal end of the battery post 2B, thereby fixing the adapter 26 to the battery 1.

Figure 14:
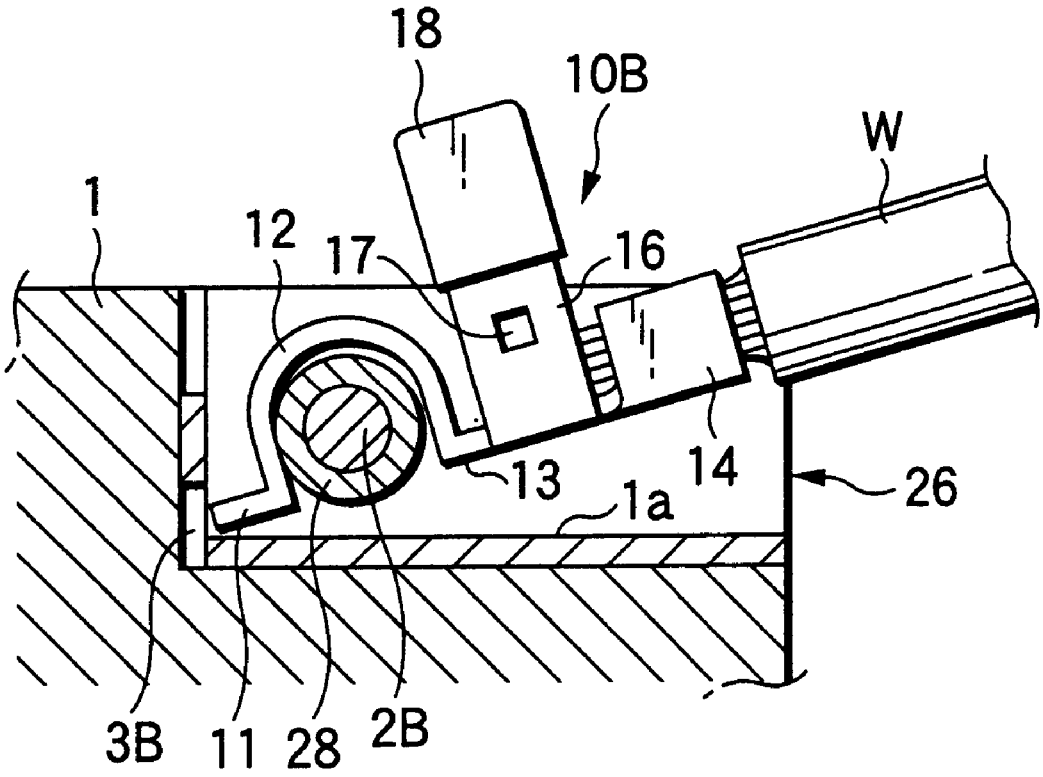
FIG. 14 is a horizontal section view of the third embodiment, showing a condition in which a distal end portion of the battery terminal is to be engaged in a retaining groove.
Figure 15:
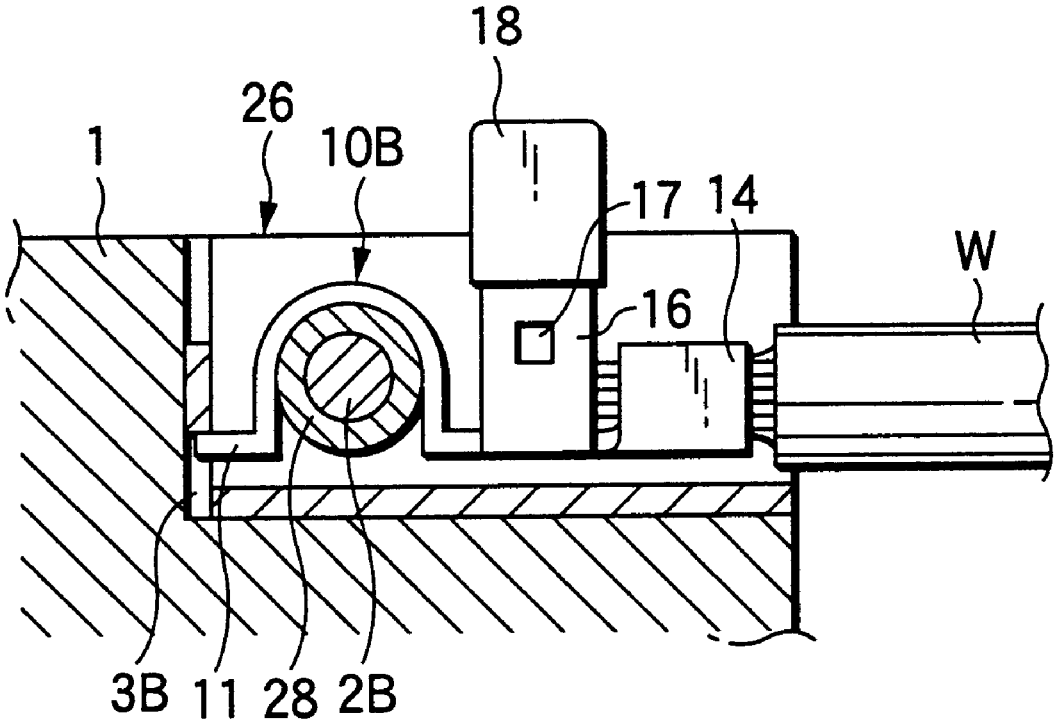
FIG. 15 is a horizontal section view of the third embodiment, showing a condition in which the battery terminal is pivotally moved until it is locked.
Figure 16:
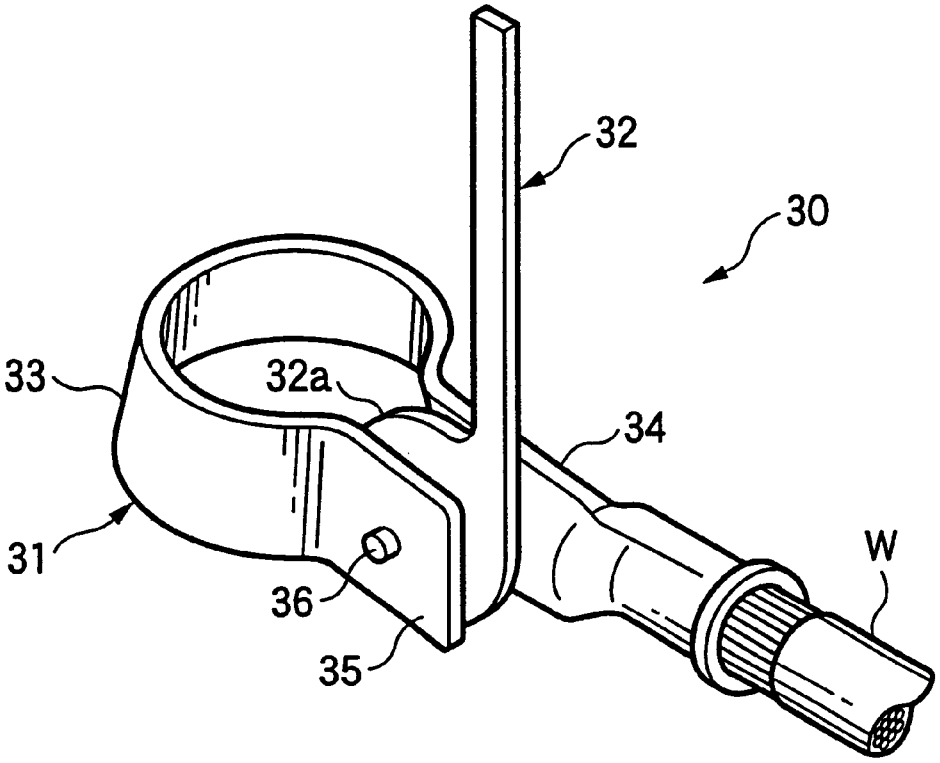
FIG. 16 is a perspective view showing a related battery terminal.
Figure 17A:
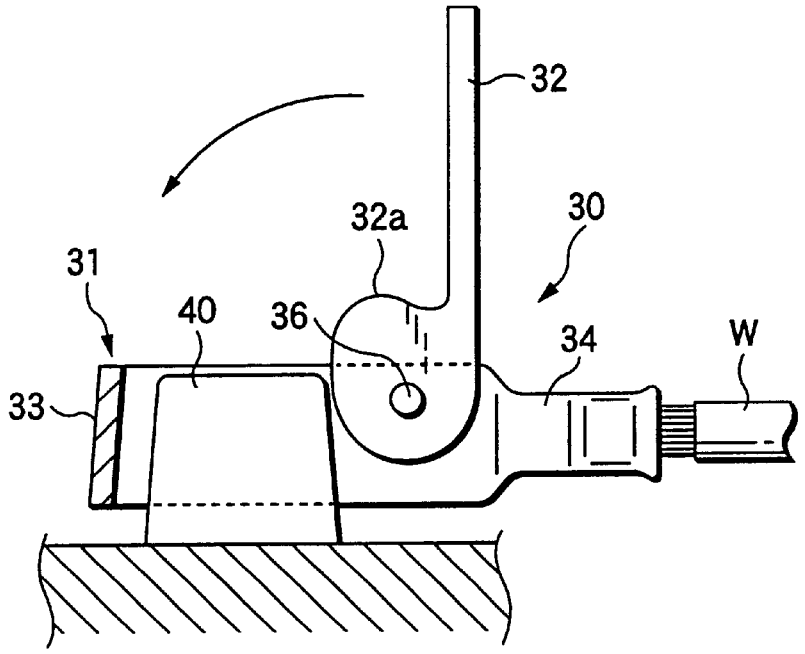
FIG. 17A is a side-elevational, section view, showing a condition in which the related battery terminal is merely set on a battery post.
Figure 17B:
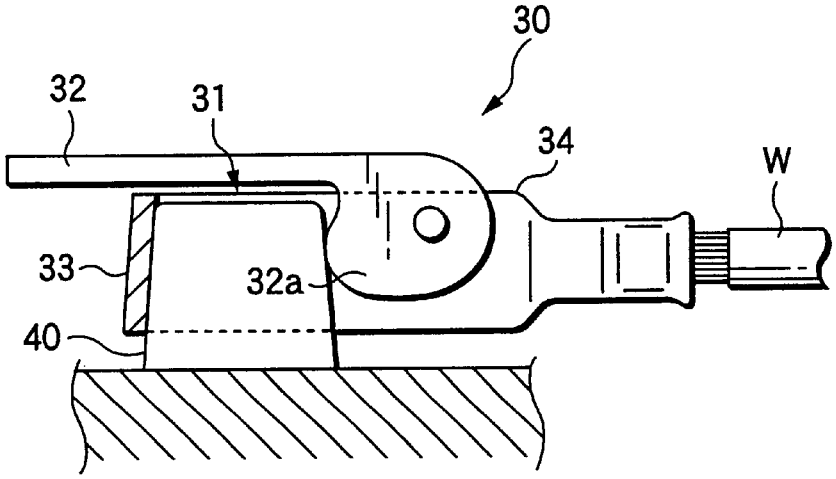
PRIOR ART FIG.17B
FIG. 17B is a side-elevational, section view showing a condition in which a lever is brought down to thereby press-fit the related battery terminal onto the battery post.

Then, as in the first embodiment, the distal end portion 11 of the battery terminal 10B is engaged in the retaining groove 3B in the adapter 26, as shown in FIG. 14, and in this condition the proximal end portion 13 of the battery terminal 10B is pivotally moved toward the battery post 2B about this retaining point as a fulcrum. As a result, the U-shaped curved portion 12, formed between the distal end portion 11 and the proximal end portion 13 of the battery terminal 10B, can be firmly press-fitted onto the peripheral face of the cylindrical portion 28 with a small force because of the leverage action, as shown in FIG. 15.

In this condition, the locking claws 29, formed on the adapter 26, are engaged respectively in the locking holes 17 in the battery terminal 10B, and therefore the U-shaped curved portion 12 can be positively held in the press-fitted condition relative to the cylindrical portion 28. This pivotal movement can be effected while gripping the distal ends of the lock arms 16 (to which the insulating covers 18 are attached, respectively) with the fingers or others. Therefore, this operation can be effected while slightly elastically deforming the lock arms 16, and the locked condition can be easily achieved. In this case, the upper and lower locking claws 29 are engaged respectively in the locking holes 17, and therefore the battery terminal 10B is held in position, so that the fixing strength is enhanced.

Thus, as in the first and second embodiments, by almost one action, that is, by pivotally moving the battery terminal 10B, with its distal end portion 11 engaged in the retaining groove 3B, the battery terminal 10B can be fitted on the battery post 2B (here, the adapter 26), and therefore the fitting operation can be simplified. In addition, the firm press-fitting can be achieved even with a small force because of the leverage action, and therefore the efficiency of the operation is enhanced, and besides the positive connection is achieved, so that the reliability of the connection is enhanced.

In the structure of this third embodiment, the locking claws 29 and the retaining groove 3B are provided at the adapter 26, and therefore the construction of the battery 1 is simplified. And besides, the lock arms 16 as provided on a connector are formed on the battery terminal 10B, and therefore the cancellation of the locked condition can be easily effected by elastically deforming the lock arms 16, and the battery terminal 10B can be easily removed from the adapter 26.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A structure for connecting a battery terminal to a battery post of a battery, comprising:

a terminal body, having a U-shaped curved portion which is formed between a distal end portion and a proximal end portion of the battery terminal;

a retaining portion, at which the distal end portion of the battery terminal is retained, the retaining portion provided in the vicinity of the battery post; and locking members, which lock the proximal end portion of the battery terminal in a position where the proximal end portion has been pivoted in a leverage manner while the distal end portion is retained in the retaining portion as a fulcrum, and while the U-shaped curved portion is press-fitted onto an outer periphery of the battery post.

2. The connecting structure as set forth in claim 1, further comprising a cover member which covers the terminal body, wherein the locking members include a first locking member provided on the cover member and a second locking member provided with the battery.

3. The connecting structure as set forth in claim 2, wherein the cover member is made of an insulative material.

4. The connecting structure as set forth in claim 2, wherein the first locking member is provided as an elastic arm member which is operable from the outside.

5. The connecting structure as set forth in claim 1, further comprising an adapter member formed with the retaining portion, the adapter member fitted on the battery post such that the retaining portion is placed in the vicinity of the battery post, wherein the locking members include a first locking member provided on the terminal body and a second locking member formed with the adapter member.

6. The connecting structure as set forth in claim 5, wherein the first locking member is provided as an elastic arm member which is operable from the outside.

7. The connecting structure as set forth in claim 6, wherein an insulative grip member is provided on a distal end of the elastic arm member.

* * * * *